United States Patent [19]

Fortier

[11] Patent Number: 4,672,789

[45] Date of Patent: Jun. 16, 1987

[54] SURFACE COVERING EXTRUDED PANEL STRIP

[76] Inventor: Guy Fortier, 100 Des Patriotes Nord, St. Hilaire, Quebec, Canada, J3H 3H1

[21] Appl. No.: 845,945

[22] Filed: Mar. 31, 1986

[51] Int. Cl.[4] ..... E04D 1/00

[52] U.S. Cl. ..... 52/520; 52/521; 52/519

[58] Field of Search ..... 52/36, 519, 520, 521, 52/539, 548, 549; 248/222.2, 243, 247, 248, 205.2

[56] References Cited

U.S. PATENT DOCUMENTS

| | | | |
|---|---|---|---|
| 3,218,772 | 11/1965 | Martin | 52/520 X |
| 3,703,795 | 11/1972 | Mattes | 52/521 |
| 4,104,841 | 8/1978 | Naz | 52/519 |
| 4,211,379 | 7/1980 | Morgan et al. | 52/36 X |
| 4,411,117 | 10/1983 | Bolha | 52/521 |
| 4,450,970 | 5/1984 | Shepherd | 248/222.2 X |
| 4,531,331 | 7/1985 | Itagaki | 52/288 X |
| 4,548,375 | 10/1985 | Moss | 248/205.2 |
| 4,579,308 | 4/1986 | Jensen | 248/222.2 X |

FOREIGN PATENT DOCUMENTS

| | | |
|---|---|---|
| 1524750 | 5/1968 | France . |
| 401422 | 3/1966 | Switzerland . |

*Primary Examiner*—William F. Pate, III
*Assistant Examiner*—Creighton Smith

[57] ABSTRACT

A surface covering extruded plank comprising a wall surface portion having opposed transverse end walls. Each of the end walls terminate in a support flange each of which extends in a common plane substantially parallel to the planar surface of the wall surface portion. One of the transverse end walls has a fastener concealing wall extending transverse thereto and above the wall surface portion. The other of the end walls has a plank securing flange constituted by an extension of one of the support flanges. This other end wall further has a recessed portion disposed inwardly of an edge portion of the wall surface portion. A guide rib is provided in the recessed portion and defines a rear channel for receiving a portion of the concealing wall of an adjacent plank, and a front load connector holding channel.

10 Claims, 4 Drawing Figures

SURFACE COVERING EXTRUDED PANEL STRIP

BACKGROUND OF THE INVENTION

1. Field of Invention

The present invention relates to a surface covering extruded plank, and preferably extruded from a plastics material, and wherein the strips are secured in side-by-side relationship with the fasteners being concealed by concealing wall portions formed integral with the plank and wherein connectors may be secured between adjacent planks without derforming or damaging the planks by a load applied to the connector.

2. Description of Prior Art

Various types of wall coverings utilizing preformed panels are known, such as described, for example, in U.S. Pat. Nos. 4,450,970 issued May 29, 1984; 3,969,866 issued July 20, 1976; 4,327,528 issued May 4, 1982; 4,531,331 issued July 30, 1985; French Patent No. 1,524,750 and Swiss Patent No. 401,422. All of these patents disclose composite panel structures interconnectable in side-by-side relationship and interconnected through a joint. The majority of these panels are made of metal sheeting and are constituted by large panel sections or multiple strip panel sections. They are either secured by screw-type fasteners or welded to a support frame or support surface.

A disadvantage of using metal panels or planks is that they are heavy to use, difficult to secure, can cause bodily injury when manipulated and installed, are expensive, are difficult to cut and cannot adapt to irregular support surfaces as they are not flexible. Also, most of these are welded and permanently secured to a support structure and thus not easily interchangeable for repair. The prior art panels are also provided in fixed lengths and the fasteners for securing them are not concealed, in most cases.

SUMMARY OF INVENTION

It is a feature of the present invention to provide a surface covering extruded plank which substantially overcomes the above-mentioned disadvantages of the prior art.

It is a further feature of the present invention to provide a surface covering extruded plank made of flexible plastics material and having fastener concealing wall portions wherein to conceal the fastneers and further defining a connector holding channel to secure a connector for attaching various objects on the wall over the planks.

Another feature of the present invention is to provide a surface covering extruded plank wherein the fastener concealing wall portion is provided with a load transfer rib to remove stress normally applied by a load supported by a connector secured to the connector holding channel between opposed planks.

According to the above features, from a broad aspect, the present invention provides a surface covering extruded plank comprising a wall surface portion having opposed transverse end walls. Each of the end walls terminate in a support flange each of which extends in a common plane substantially parallel to the planar surface of the wall surface portion. One of the transverse end walls has a fastener concealing wall extending transverse thereto and above the wall surface portion. The other of the end walls has a plank securing flange constituted by an extension of one of the support flanges. This other end wall further has a recessed portion disposed inwardly of an edge portion of the wall surface portion. A guide rib is provided in the recessed portion and defines a rear channel for receiving a portion of the concealing wall of an adjacent plank, and a front load connector holding channel.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
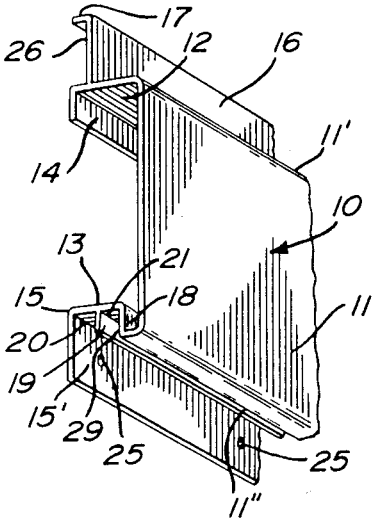
FIG. 1 is a perspective view of an end portion of a plank constructed in accordance with the present invention.

Referring to the drawings, and more particularly to FIG. 1, there is shown generally at 10, a surface covering extruded plank of the present invention. The plank comprises a wall surface portion 11 having opposed transverse elongated end walls 12 and 13. Each of the end walls 12 and 13 terminate in a support flange 14 and 15, respectively, each of which extends in a common plane substantially parallel to the planar surface of the wall surface portion 11.

One of the transverse end walls, herein end wall 12, has a fastener concealing wall 16 extending transverse to the end wall 12 above a side edge 11' of the wall surface portion 11. As hereinshown, both of the end walls extend rearwardly transverse to the wall surface portion 11 which is hereinshown as a flat wall. This wall may also be provided with rib formations or other designs therein. The fastener concealing wall 16 is further provided with a load transfer rib 17 is a free end thereof. This load transfer rib 17 extends in a rearward direction toward the support flange 14.

The other end wall 13 has a plank securing flange herein constituted by an extension portion 15' of the support flange 15. The end wall 13 is further provided with a recessed portion 18 disposed inwardly of the other side edge portion 11'' of the wall surface portion 11. A guide rib 19 extends longitudinally in the recessed portion 13 whereby to define a rear channel 20 for receiving a portion of the concealing wall 16 and its rib 17. The guide rib 19 further defines a forward connector holding channel 21 for receiving therein the load support connector 22 as shown in FIGS. 2 to 4.

Figure 2:
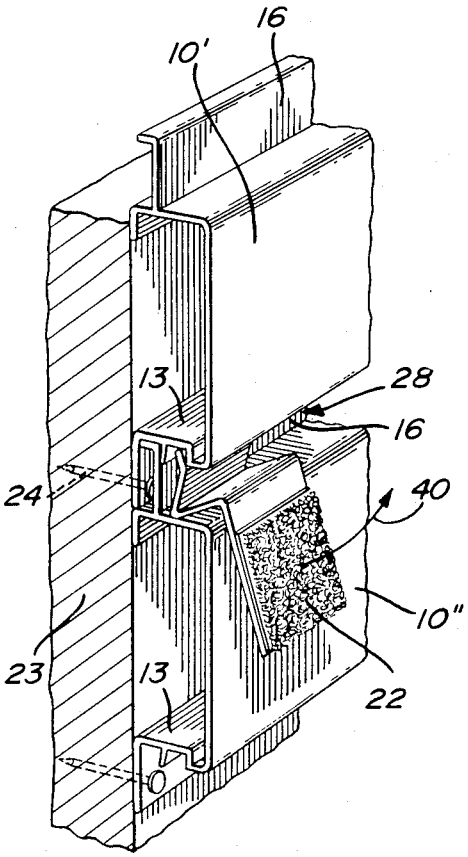
FIG. 2 is a perspective fragmented view of two extruded planks secured in side-by-side relationship defining a connector holding channel therebetween and showing a connector secured in the holding channel.
Figure 3:
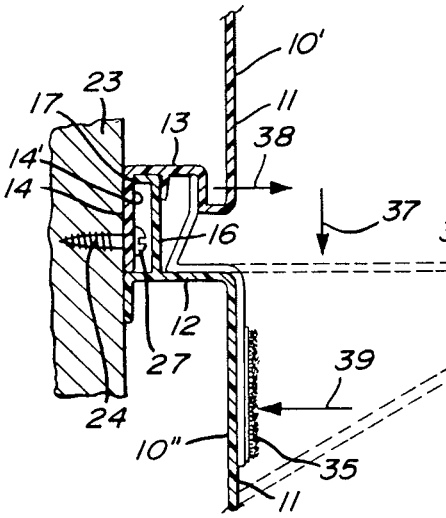
FIG. 3 is a fragmented section view of a portion of FIG. 2 and showing an alternative construction of the load support connector.
Figure 4:
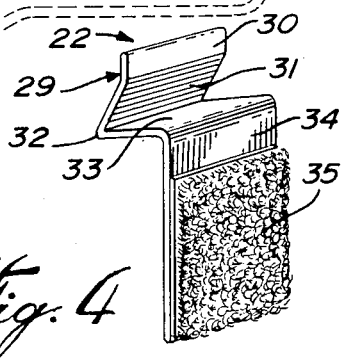
FIG. 4 is a perspective view of a load support connector.

Referring now additionally to FIGS. 2 to 4, there is shown a portion of a wall covering which is constituted by a plurality of planks 10 secured in side-by-side relationship. Only two of such planks 10' and 10'' are herein shown to facilitate illustration of the invention. As shown more clearly in FIG. 3, when securing two planks 10' and 10'' in side-by-side relationship, it is firstly necessary to position plank 10' against a backing wall or support struts 23. Fasteners 24 are then inserted through holes 25 in the plank securing flange 15' to secure the plank. Depending on the material used in the extrusion of the plank, these holes may not be necessary. The adjacent plank 10'' is then positioned with the fastener concealing wall 16 and load transfer rib 17 disposed within the rear channel 20. The load transfer rib 17 extends parallel to the transverse end wall 12 and terminates in an abutment edge 17' which abuts on the outer surface 14' of the support flange 14 for a reason which will be described later on. As can be seen from FIG. 3, the fastener concealing wall 16 defines a fastener head receiving cavity 26 rearwardly thereof between the load tranfer ribs 17 and the transverse end wall 12 whereby to conceal therein the head 27 of the fastener 24. The second plank 10'' being thus so positioned, it can now be secured to the backing wall 23 in the same manner as the extruded plank 10'. In addition to securing the flange 14 by means of fasteners 24, glue may also be applied to the back wall of the flange 14.

The extruded plank as hereinshown is preferably made from a strong plastics material exhibiting strong resistive properties to abrasion and having sufficient flexibility whereby the planks can conform to a support backing wall which may have a non-uniform surface. The plastics material further has the characteristics of being light, safe to use, easy to cut, conceals slight abrasion if scratched and may be extruded in various colored plastics or simulated woodgrain finish. Being extruded, all of the parts of the plank herein described are continuous and thus offer structural rigidity to the plank. Also, the fact that the strips are narrow single planks, they are more easily adaptable to cover irregular surfaces or surfaces of small width. Also, the planks can be extruded at any length thus eliminating the necessity of aligning joints at the ends of planks, as is the case with the prior art.

In order to hold the load support connector 22 in the channel opening 28 defined between adjacent planks 10' and 10'', the front connector holding channel 21 defines an abutment front wall 21' spaced rearwardly of the wall surface portion 11 behind the edge portion 11''.

As shown more clearly in FIGS. 3 and 4, the load support connector 22 has a securing flange portion 29 comprised of an abutment end portion 30 defined by a flat abutment wall and a wedge wall portion 31 extending angularly rearwardly of the abutment end portion 30 and terminating in a wedge edge 32. A spacer portion 33 extends forwardly of the wedge edge 32 and terminates in a load support portion 34. As hereinshown, the load support portion 34 extends in an opposite direction to the securing flange portion 29 at substantially 90° to the spacer portion 33 and is herein provided with a Velcro (Registered Trademark) attachment piece 35 to retain an object (not shown) also having a Vecro connector.

The load support connector 22 may also have a load support portion 34' (see FIG. 3) which extends outwardly and perpendicular to the wall surface portion 11 whereby to constitute a support bracket. An angled support flange 36 is also formed integral with the bracket 34' and bridges the support bracket 34' and a wall surface portion 11 of the adjacent plank 10'' whereby to transfer the load on the support bracket 34' back into the plank 10'' and into the rear channel 20 of the opposed plank 10' via the load transfer rib 17. Accordingly, when a load is applied downwardly in the direction of arrow 37 either on the load support bracket 34' or by attachment to the Velcro fastener 35, this downward load generates a pulling force in the direction of arrow 38 between the abutment end portion 30 of the load support connector 22 and the abutment front wall 21' of the connector holding channel 21. However, this force is counteracted by the resulting rearward pushing force of the load, herein indicated by arrow 39, acting in the opposite direction and transferred to the rib 17 thus providing opposed loading in the recessed channel end wall 13 and substantially cancelling the pulling force 38.

In order to remove the load support connector 22, it is simply necessary to displace the load support portion 34 upwardly in the direction of arrow 40 as shown in FIG. 2 and the connector disengages from the holding channel 21. However, when a load is applied to the load support portion 34 or 34', the wedge portion 33 and wedge end 32 are subjected to inward pressure to stabilize the connector securing flange 29 and to hold it firmly between the channel 21 and the upper surface of the side edge 11' of the adjacent or lower plank 10''. The load support portions 34 and 34' as hereinshown are only illustrations of the configuration of such portions and it is within the ambit of the present invention to cover any other type load supporting portions. For example, this portion could be formed as a tray for holding spice bottles, utensils, etc. or may be formed as a glass or potholder and may have a multitude of other forms and uses.

It is within the ambit of the present invention to cover any obvious modifications of the example of a preferred embodiment described herein, provided such modifications fall within the scope of the appended claims.

I claim:

1. A surface covering extruded plank comprising a wall surface portion having opposed transverse end walls, each said end wall terminating in a support flange, each of which extends in a common plane substantially parallel to the planar surface of said wall surface portion, one of said transverse end walls having a fastener concealing wall extending transverse thereto and above said wall surface portion, the other of said end walls having a plank securing flange constituted by an extension of one of said support flanges, said other of said end walls further having a recessed portion disposed inwardly of an edge portion of said wall surface portion, said wall surface portion, a guide rib in said recess portion defining a rear channel for receiving a portion of said concealing wall of an adjacent plank and a front load connector holding channel, said fastener concealing wall having a load transfer rib in a free end thereof which extends in a rearward direction toward said support flange, said load transfer rib extending parallel to said one of said transverse end walls and terminates in an abutment edge disposed in a plane spaced from a rear surface of said support flanges a distance equal to the thickness of said securing flanges whereby to abut against said panel strip securing flange of an adjacent plank.

2. An extruded plank as claimed in claim 1, wherein said fastener concealing wall defines a fastener head receiving cavity rearwardly thereof between said load transfer rib and said one of said transverse end walls.

3. An extruded plank as claimed in claim 1, wherein said support flanges are continuous flat surface flanges, said plank securing flange being provided with a pluraliyy of fastener receiving bores therein.

4. An extruded plank as claimed in claim 1, wherein said plank is an elongated extruded plastic plank having a continuous wall surface portion, end walls, support flanges, fastener concealing wall, panel concealing wall and load transfer rib.

5. An extruded plank as claimed in claim 1, wherein said front connector holding channel defines an abutment front wall spaced rearwardly of said wall surface portion behind said edge portion, said abutment front wall coacting with a removable connector securement flange.

6. An extruded plank system as claimed in claim 5 in combination with said removable connector, there being at least two of said planks secured side-by-side by fasteners extending through said securing flange of each plank with said load transfer rib located in said rear channel and said fastener concealing wall extending over said fasteners; said connector having a securing flange, a spacer portion and a load support portion all integrally formed; said securing flange being held captive in said front connector holding channel between said abutment front wall and said transverse end wall of an adjacent plank having said fastener concealing wall, said load support portion extending outwardly of said wall surface portion.

7. An extruded plank system as claimed in claim 6, wherein said connector securing flange comprises an abutment end portion defined by a flat abutment wall, a wedge wall portion extending angularly rearwardly of said abutment end portion and terminating in a wedge edge, said spacer portion being a wall portion extending forwardly from said wedge edge.

8. An extruded plank system as claimed in claim 7, wherein said load support portion is a downwardly extending support tab extending from said spacer portion and over an edge portion of said wall surface portion of said adjacent plank, and attachment means associated with said load support portion.

9. An extruded plank system as claimed in claim 8, wherein said attachment means is a Velcro material secured to said load support portion.

10. An extruded plank system as claimed in claim 9, wherein load support portion is a vertical support bracket having a horizontal support member extending transversely and forwardly of said side wall surface portion, and an angled support flange bridging said horizontal support member and a face of said adjacent plank.

* * * * *